US011114264B2

(12) United States Patent
Chen et al.

(10) Patent No.: US 11,114,264 B2
(45) Date of Patent: Sep. 7, 2021

(54) INSERTION STRUCTURE BETWEEN STATIC SPRING AND BOBBIN

(71) Applicant: Xiamen Hongfa Automotive Electronics Co., Ltd., Fujian (CN)

(72) Inventors: Zhenghe Chen, Xiamen (CN); Leopold Mader, Xiamen (CN); Cunji Du, Xiamen (CN)

(73) Assignee: Xiamen Hongfa Automotive Electronics Co., Ltd., Fujian (CN)

( * ) Notice: Subject to any disclaimer, the term of this patent is extended or adjusted under 35 U.S.C. 154(b) by 229 days.

(21) Appl. No.: 16/464,248

(22) PCT Filed: Nov. 24, 2017

(86) PCT No.: PCT/CN2017/112911
§ 371 (c)(1),
(2) Date: May 24, 2019

(87) PCT Pub. No.: WO2018/095417
PCT Pub. Date: May 31, 2018

(65) Prior Publication Data

US 2019/0272967 A1 Sep. 5, 2019

(30) Foreign Application Priority Data

Nov. 24, 2016 (CN) ..... 201611042825.5
Nov. 24, 2016 (CN) ..... 201611043815.3
(Continued)

(51) Int. Cl.
*H01H 50/44* (2006.01)
*H01H 50/26* (2006.01)
*H01H 50/36* (2006.01)

(52) U.S. Cl.
CPC ..... *H01H 50/44* (2013.01); *H01H 50/26* (2013.01); *H01H 50/36* (2013.01); *H01H 2050/446* (2013.01)

(58) Field of Classification Search
CPC ... H01H 50/44; H01H 50/14; H01H 2050/446
(Continued)

(56) References Cited

U.S. PATENT DOCUMENTS 5,291,166 A 3/1994 Chikira
5,894,253 A * 4/1999 Ichikawa ..... H01H 50/042 335/78
(Continued)

FOREIGN PATENT DOCUMENTS

CN 1399293 A 2/2003
CN 2752945 Y 1/2006
(Continued)

OTHER PUBLICATIONS

Japanese communication dated Aug. 18, 2020 in connection with Japanese Application No. 2019-528747.
(Continued)

*Primary Examiner* — Alexander Talpalatski
(74) *Attorney, Agent, or Firm* — Wolf, Greenfield & Sacks, P.C.

(57) ABSTRACT

The present disclosure relates to an insertion structure between a stationary spring and a bobbin, comprising: a stationary spring and a bobbin; wherein the stationary spring is inserted into the bobbin by a flip-chip method, and the bobbin is provided with slots, each having a groove shape with a laterally open in formed by an L-shaped side wall connecting with a convex wall, and each of two sides of the stationary spring is provided with a convex part, and two convex parts of the stationary spring are respectively fitted into the two opposite slots; a first blocking wall is provided
(Continued)

along a horizontally extending direction of protruding of the convex wall, and a second blocking wall is further provided between the first blocking wall and the L-shaped side wall to connect them, and the convex parts of the stationary spring are mounted.

11 Claims, 17 Drawing Sheets

(30) Foreign Application Priority Data

Nov. 24, 2016 (CN) ..... 201621264319.6
May 5, 2017 (CN) ..... 201720493015.5

(58) Field of Classification Search
USPC ..... 336/198, 221
See application file for complete search history.

(56) References Cited

U.S. PATENT DOCUMENTS

| | | | | |
|---|---|---|---|---|
| 6,359,537 | B1 * | 3/2002 | Ichikawa | H01H 49/00 335/78 |
| 6,940,375 | B2 * | 9/2005 | Sanada | H01H 50/56 335/129 |
| 7,477,119 | B2 * | 1/2009 | Wu | H01H 50/043 335/128 |
| 8,102,227 | B2 * | 1/2012 | Fujiwara | H01H 50/643 335/78 |

FOREIGN PATENT DOCUMENTS

| | | | |
|---|---|---|---|
| CN | 2877024 | Y | 3/2007 |
| CN | 103065875 | A | 4/2013 |
| CN | 103413730 | A | 11/2013 |
| CN | 103426687 | A | 12/2013 |
| CN | 205487970 | U | 8/2016 |
| CN | 106098475 | A | 11/2016 |
| CN | 106298369 | A | 1/2017 |
| CN | 106558459 | A | 4/2017 |
| CN | 106558460 | A | 4/2017 |
| CN | 206236617 | A | 6/2017 |
| CN | 206236619 | U | 6/2017 |
| EP | 1 164 613 | A1 | 12/2001 |
| EP | 2 590 194 | A1 | 5/2013 |
| JP | H08-502383 | A | 3/1996 |
| JP | 2006012565 | A | 1/2006 |
| JP | 2011-044281 | A | 3/2011 |

OTHER PUBLICATIONS

International Search Report and Written Opinion for International Application No. PCT/CN2017/112911 dated Feb. 12, 2018.
Extended European Search Report in connection with European Application No. 17874232.6, dated May 4, 2020.

* cited by examiner

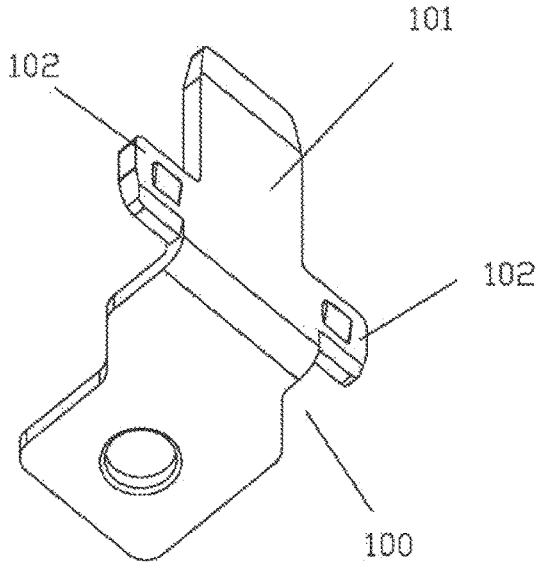
Fig.1 （Prior Art）
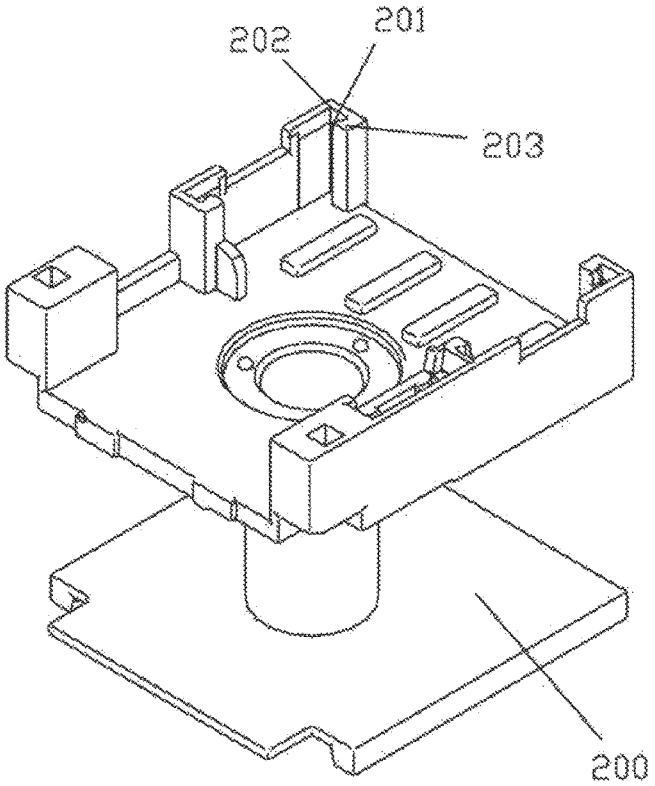
Fig.2 （Prior Art）

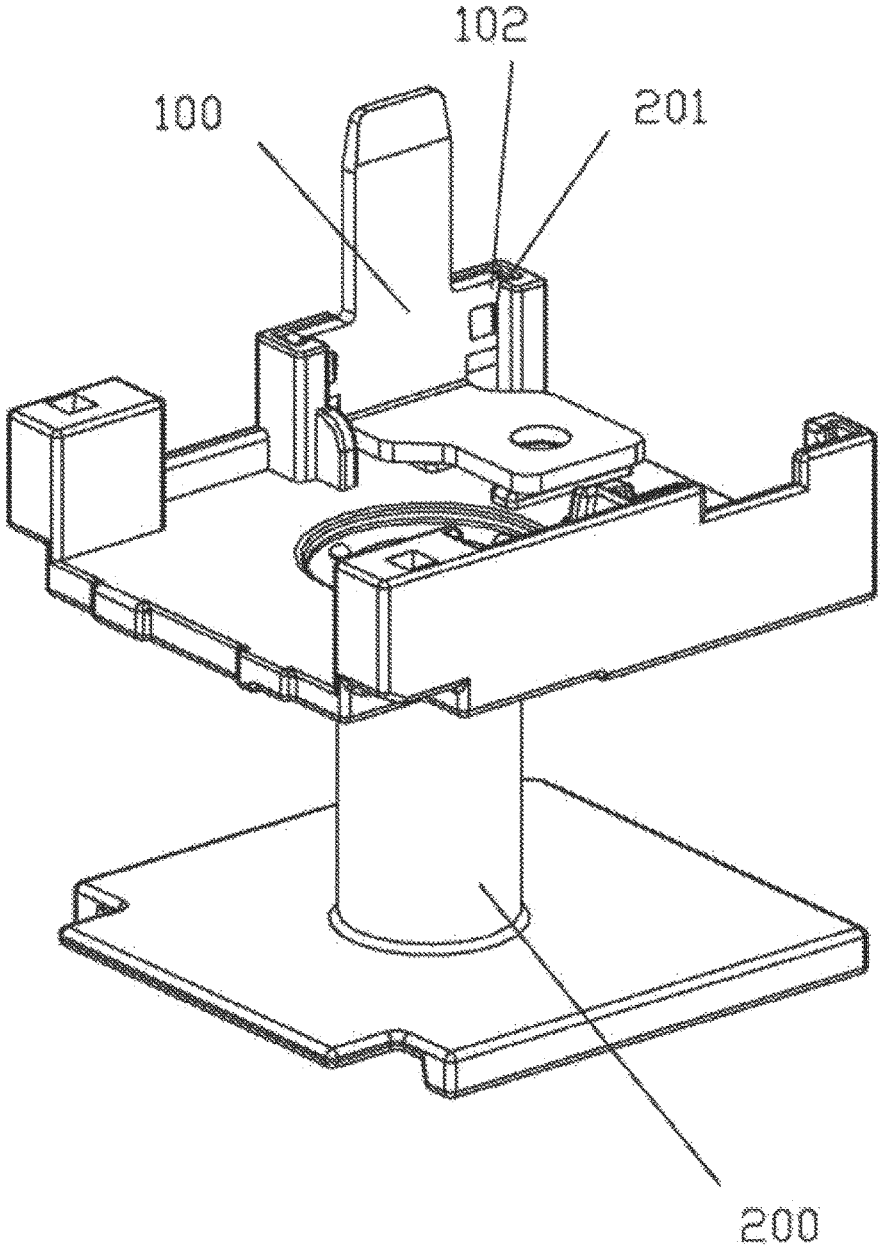
Fig.3 （Prior Art）

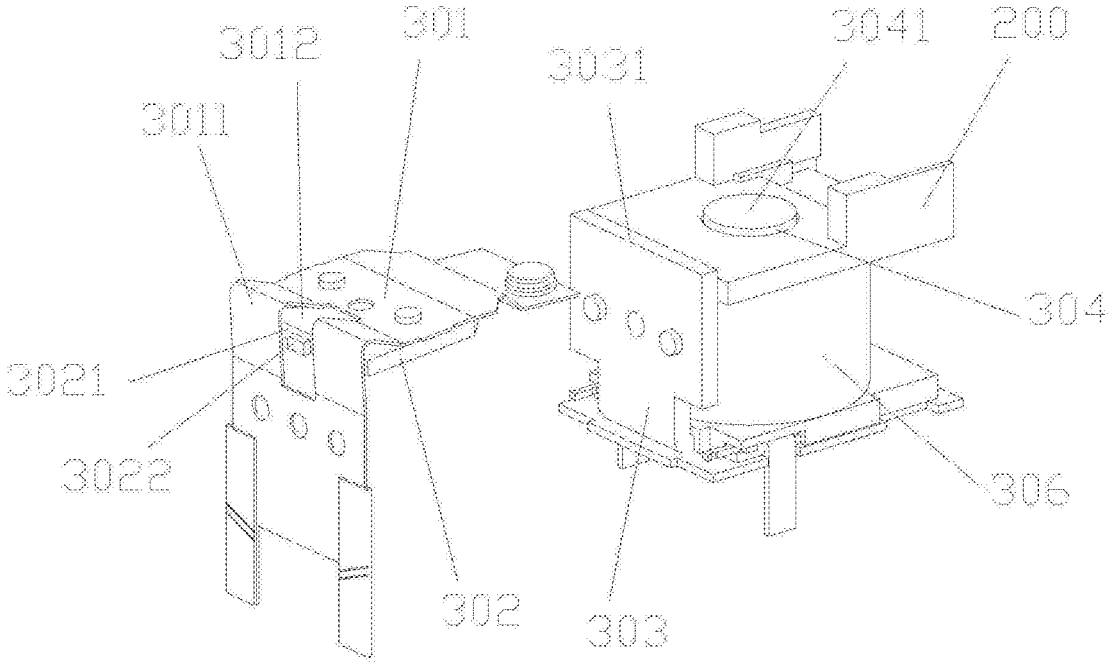
Fig.18（Prior Art）
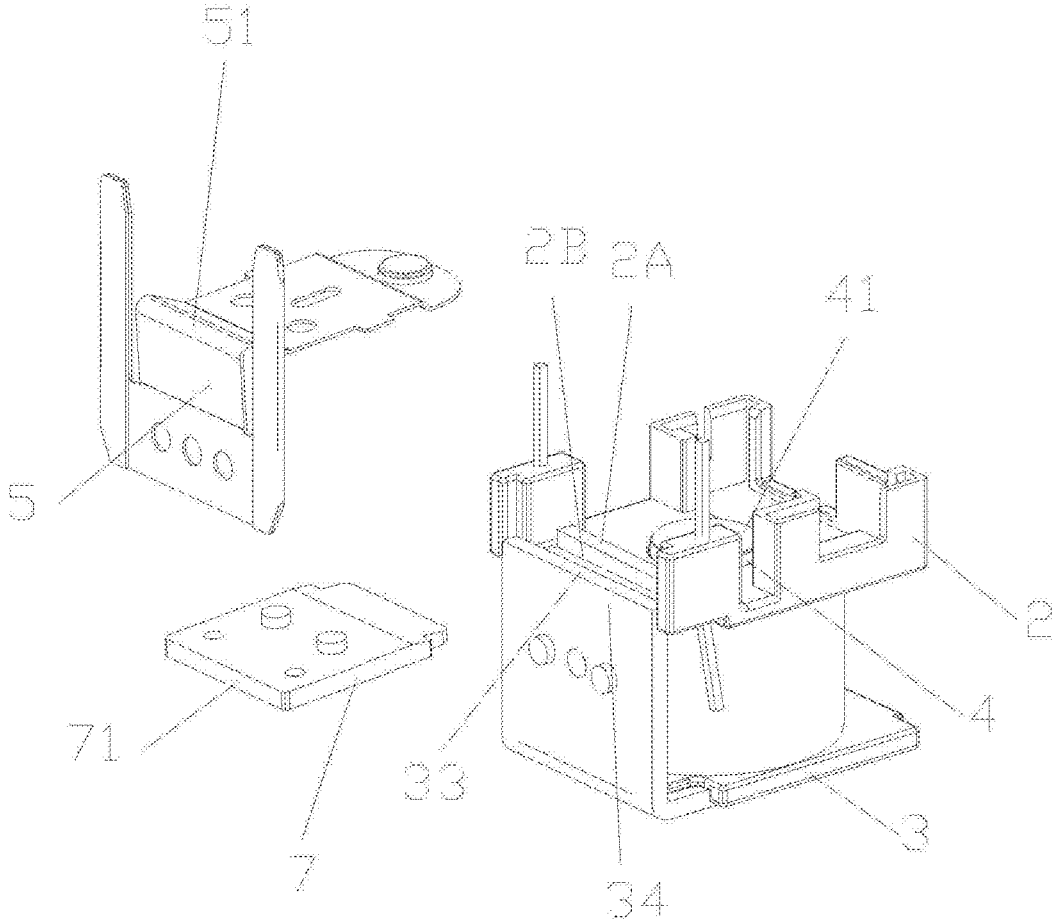
Fig.19

Fig.25 （Prior Art）

INSERTION STRUCTURE BETWEEN STATIC SPRING AND BOBBIN

RELATED APPLICATIONS

This application is a national stage filing under 35 U.S.C. § 371 of international PCT application number PCT/CN2017/112911, filed Nov. 24, 2017, which claims the benefit of Chinese Patent Application No. 201720493015.5, filed on May 5, 2017, Chinese Patent Application No. 201611042825.5, filed on Nov. 24, 2016, Chinese Patent Application No. 201611043815.3, filed on Nov. 24, 2016 and Chinese Patent Application No. 201621264319.6, filed on Nov. 24, 2016, the entire contents of each of which are incorporated herein by reference.

TECHNICAL FIELD

The present disclosure relates to the field of relay/circuit breaker technology, and relates to a miniaturized impact-resistant clapper-type relay, and in particularly to an insertion structure between a static spring and a bobbin of a miniaturized relay.

BACKGROUND

A relay is an electrical control device that is an electrical device that causes a predetermined step change in the controlled output quantity in the electrical output circuit when a change in the input amount (excitation amount) reaches specified requirements. It has an interaction between the control system (also known as the input loop) and the controlled system (also known as the output loop). Relays are usually used in automated control circuits. They are actually an "automatic switch" that uses a small current to control the operation of a large current, thus playing a role of automatic adjustment, safety protection and conversion circuit in circuits. A circuit breaker is a switching device that can close, carry and break current under normal circuit conditions and can close current, carry and break current under abnormal loop conditions within a specified time. In the relay/circuit breaker, it usually includes components such as a static spring, a bobbin, a base, etc., and the static spring is inserted into the bobbin or the base as needed.

In the relay of the related art, a magnetic circuit part is located at the bottom and a contact part is located at the top, Since the contact part and pins of a moving spring are all underneath, this will result in that the moving spring, a normally closed static spring and a normally opened static spring are made of a large amount of material, and a conductive distance is long, and an internal resistance is large, which makes it difficult for product to increase its load with a small volume. Although structures of some relays are designed as flip-chip structures, a design of assembly of the static spring is complicated, and the static spring is generally fixed at a bottom plate, which leads to a dispersion of key dimensions and high precision requirements for parts of the product. Or a side of the static spring is inserted in the bobbin such a mold of the bobbin has a complicated structure and a poor dimensional stability. It further makes a size of the relay in the related art larger and unable to achieve miniaturization.

Moreover, a static spring of the related art is fixed in the bobbin by flip-chip method. FIG. 1 is a schematic structural view of a static spring in the related art. As shown in FIG. 1, the static spring 100 is provided with an L-shape and is mounted to the bobbin by the flip-chip method. FIG. 2 is a schematic structural view of a bobbin in the related art. As shown in FIG. 2, the bobbin 200 is provided with a slot 201. A side 101 of the static spring 100 configured for inserting is provided with convex parts 102. The slot 201 of the bobbin 200 is designed as a groove shape which is formed by a side wall 202 with an L shape and a convex wall 203. FIG. 3 is a schematic diagram of inserting and assembling of the static spring and the bobbin in the related art. As shown in FIG. 3, when the static spring 100 is inserted into the bobbin, the convex parts 102 on two sides of the static spring 100 are inserted into the slot 201 of the bobbin 200. Since the static spring 100 is usually a metal component and the bobbin 200 is usually a plastic component, during the process of an inserting and assembling, shaving debris is generated around inserted static spring 100. If this shaving debris is not cleaned, the inside of the relay will be vibrated, thereby causing pollution inside the relay and affecting normal use of the relay. However, existing method for dealing with the shaving debris is mainly to use a method of air blowing to remove generated shaving debris. In this way, on the one hand, the process is complicated, and on the other hand, it is not easy to clean up.

SUMMARY

The purpose of embodiments of the present disclosure is to overcome deficiencies of the related art and an insertion structure between a static spring and a bobbin is provided. Generated shaving debris can be enclosed in a specific space without going into inside of the relay/circuit breaker by improvement of a slot structure of the bobbin, thereby ensuring the normal use of the relay/circuit breaker.

On another aspect, the embodiments of the present disclosure can reduce volume of the relay by improvement of structures, thereby realizing miniaturization of product of the relay.

On another aspect, the embodiments of the present disclosure can improve impact resistance of the product of the relay, and can reduce manufacturing cost of the product of the relay.

On another aspect, the embodiments of the present disclosure can improve stability of operation of a double-contact moving spring by modification of a moving spring structure.

A technical solution adopted by the embodiment of the present disclosure to solve the technical problem thereof is that an insertion structure between a static spring and a bobbin, including: a static spring and a bobbin. in the embodiment, the static spring is inserted into the bobbin by a flip-chip method, and the bobbin is provided with slots, and each of the slots having a groove shape with a laterally open is formed by an L-shaped side wall connecting with a convex wall and each of two sides of the static spring is provided with a convex part respectively, and two convex parts of the static spring are respectively fitted in the two opposite slots. In the embodiment, a first blocking wall is further provided along a horizontally extending direction of protruding of a convex wall of the bobbin, and a second blocking wall is further provided between the first blocking wall and the L-shaped side wall to connect the first blocking wall and the L-shaped side wall, and the convex parts of the static spring is mounted at the second blocking wall, so that shaving debris generated when the convex parts of the static spring is inserted into the slots of the bobbin falls into a cavity enclosed by the first blocking wall, the second blocking wall, the L-shaped side wall and the convex wall.

A height of the second blocking wall is lower than the height of the first blocking wall.

The first blocking wall and the convex wall are designed as an integrated structure.

The second blocking wall and the first blocking wall are designed as an integrated structure.

The second blocking wall is provided to vertically connect between the first blocking wall and a surface of the L-shaped side wall. The static spring is designed as an L shape.

The height of the first blocking wall is lower than the height of the convex wall.

A bottom edge of a convex part of the static spring is provided with a first wedge chamfer. A side edge of the convex part of the static spring is provided with a second wedge chamfer.

Compared with the related art, beneficial effects of the embodiments of the present disclosure are as follows. Since the embodiment of the present disclosure adopts that the first blocking wall is further provided along the horizontally extending direction of protruding of a convex wall of the bobbin, and the second blocking wall is further provided between the first blocking wall and the L-shaped side wall and to connect the first blocking wall and the L-shaped side wall, and the convex parts of the static spring is mounted at the second blocking wall, so that the shaving debris generated when the convex parts of the static spring is inserted into the slots of the bobbin falls into a cavity enclosed by the first blocking wall, the second blocking wall, the L-shaped side wall and the convex wall. The structure of the embodiments of the present disclosure may enable the shaving debris generated when the convex parts of the static spring is inserted into the slots of the bobbin falls into a cavity enclosed by the first blocking wall, the second blocking wall, the L-shaped side wall and the convex wall. After the static spring is inserted into a specific position, the convex part of static spring blocks the cavity from the top, thus naturally forming a closed space, so that the shaving debris generated when the static spring is inserted into the slots are in the closed space and cannot enter inside of the relay/circuit breaker, thereby ensuring normal use of the relay/circuit breaker.

Another aspect of the embodiments of the present disclosure provides a miniaturized relay with low-cost and high-load. The relay includes a moving spring armature part, a magnetic circuit part and a contact part. In the embodiment, the moving spring armature part includes a moving spring and an armature. The magnetic circuit part includes a yoke iron, an iron core and a bobbin. The yoke iron, the iron core and the bobbin are matched assembled together. The yoke iron is provided with a knife edge. When the moving spring armature part is matched with the magnetic circuit part, a trail end of the armature is matched to the knife edge of the yoke iron. The contact part includes a normally opened static spring and a normally closed static spring. The normally opened static spring and the normally closed static spring are mounted to one end of the bobbin installed with the pole surface of the iron core, so that static contacts of the normally opened static spring and the normally closed static spring can match with a moving contact of the moving spring, and leading pins of the normally opened static spring, the normally closed static spring and the moving spring are respectively oriented in a direction in which the moving contact and the static contacts are separated.

According to any one of the embodiments described above, a first convex part is provided at at least one edge of the width of the normally opened static spring, and the bobbin is provided with first slots configured to match inserting the first convex part provided at the one edge or two edges of the normally opened static spring.

According to any one of the embodiments described above, the first slot is a blind hole structure.

According to any one of the embodiments described above, a second convex part is provided at at least one edge of the width of the normally closed static spring, and the bobbin is provided with second slots configured to match inserting the second convex part provided at the one edge or two edges of the normally closed static spring.

According to any one of the embodiments described above, the second slot is a blind hole structure.

According to any one of the embodiments described above, one side edge of the armature is provided with a convex plate that protrudes outward. In the bobbin, a groove is provided at a position corresponding to the convex plate of the armature. The convex plate of the armature is matched in the groove of the bobbin to form a limit in front and rear directions of the moving spring armature component by matching of the convex plate and the groove.

According to any one of the embodiments described above, stepped structures are provided on two sides of a head part of the armature, respectively, convex shoulders are provided at positions corresponding to the stepped structures 73 of the bobbin, respectively. By the matching of the convex shoulders of the bobbin and the stepped structures of the armature, the impact resistance of the moving spring armature component in the direction from a tail end of the armature toward the head part of the armature may be formed.

According to any one of the embodiments described above, the leading pins of the moving spring are formed by laminating the moving spring bodies.

Another aspect of the embodiments of the present disclosure provides a miniaturized anti-shock clapper-type relay. The relay includes the bobbin, the yoke iron, the iron core, the moving spring and the armature. After the moving spring is bent, one edge thereof is fixed to the armature to form a moving spring armature component. The bobbin, the yoke iron, the iron core and the moving spring armature component are matched together according to a manner of the clapper-type structure. In the embodiment, the moving spring armature component, at the tail part of the armature, a first convex bract projecting toward the bobbin is provided at a matching position close to the knife edge of the armature. At the bobbin, a retaining rib is provided at a position close to the knife edge of the armature, and the retaining rib and a terminal portion of the armature at the knife edge of the armature are surrounded to form a groove. The first convex bract of the armature is matched in the groove to form a limit on the moving spring armature component in two directions by the matching of the first convex bract and the groove.

According to any one of the embodiments described above, the retaining rib is designed as a strip shape, and the retaining rib is located between the knife edge of the armature and the pole surface of the iron core. And the retaining rib is substantially parallel to the end of the head part of the armature at the knife edge of the armature.

According to any one of the embodiments described above, the first convex bract and the retaining rib are provided with a preset gap. The matching of the first convex bract and the retaining rib can form the impact resistance of the moving spring armature component in the direction from the tail end of the armature toward the head part of the armature.

According to any one of the embodiments described above, the first convex bract and the head end of the armature at the knife edge of the armature are provided with a preset gap. The matching of the first convex bract and the terminal portion of the armature at the knife edge of the armature can form the impact resistance of the moving spring armature component in the direction from the head part of the armature toward the tail end of the armature.

According to any one of the embodiments described above, the number of the first convex bract is two.

Another aspect of the embodiments of the present disclosure provides a relay capable of improving the stability of the double-contact moving spring. The relay includes a double-contact moving spring and two static springs. The double-contact moving spring includes a moving spring reed and two moving contacts fixed to the moving spring. The static springs include static spring reeds and stationary contacts fixed to the static spring reeds. The two moving contacts of the double-contact moving spring are respectively located at positions in correspondingly with the stationary contacts of the two static springs. The moving spring reed is provided with a slot extending inwardly from the head part to divide the moving spring reed into two parts. Free end parts of the two parts of the moving spring are respectively connected to the two moving contacts. Root parts of the two parts of the moving spring are integrally connected. In one embodiment, a connecting part is further provided between the free end parts of the two parts of the moving spring reed. The connecting part is integrally connected between the free end parts of the two parts of the moving spring reed.

According to any one of the embodiments described above, the connecting part is vertically connected between the free end parts of the two parts of the moving spring reed.

According to any one of the embodiments described above, the connecting part is connected between the end parts of the free end parts of the two parts of the moving spring reed.

According to any one of the embodiments described above, the connecting part is vertically connected between the end parts of the free end parts of the two parts of the moving spring reed.

According to any one of the embodiments described above, one end of the slot extends to the junction of the moving spring reed and the armature, and the other end of the slot passes over a connecting line between centers of the two moving contacts.

According to any one of the embodiments described above, the moving contact and the moving spring reed are fixed by riveting or welding.

According to any one of the embodiments described above, the static contacts and the static spring reeds are fixed by riveting or welding.

The embodiments of the present disclosure are further described in detail below with reference to accompanying drawings. However, the structure of the present disclosure is not limited to illustrated embodiments.

BRIEF DESCRIPTION OF THE DRAWINGS

FIG. 1 is a schematic structural view of a static spring in the related art;

FIG. 2 is a schematic structural view of a bobbin in the related art;

FIG. 3 is an assembled schematic diagram of the static spring and the bobbin in the related art;

FIG. 18 is a perspective schematic view of a clapper-type relay (a moving spring armature part is in a disassembly state) in the related art;

FIG. 19 is a perspective schematic view of an embodiment of the present disclosure;

DETAILED DESCRIPTION

Figure 4:
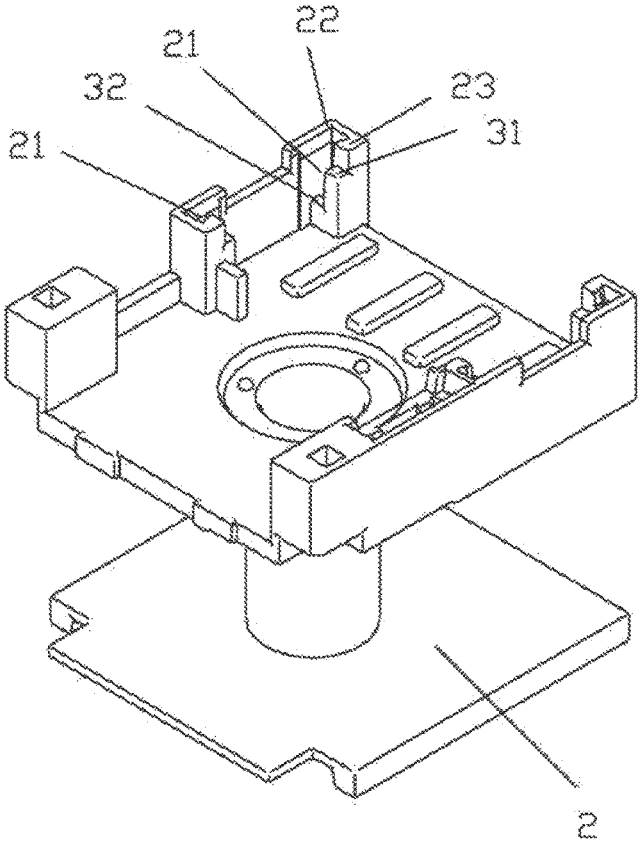
FIG. 4 is a schematic structural view of an embodiment of the present disclosure.
Figure 5:
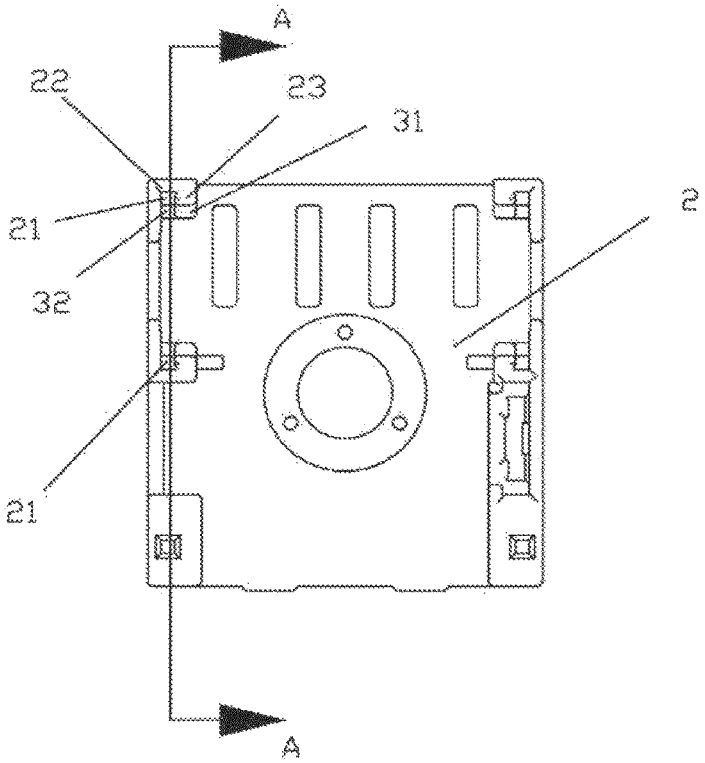
FIG. 5 is a top view of a bobbin of an embodiment of the present disclosure.
Figure 6:
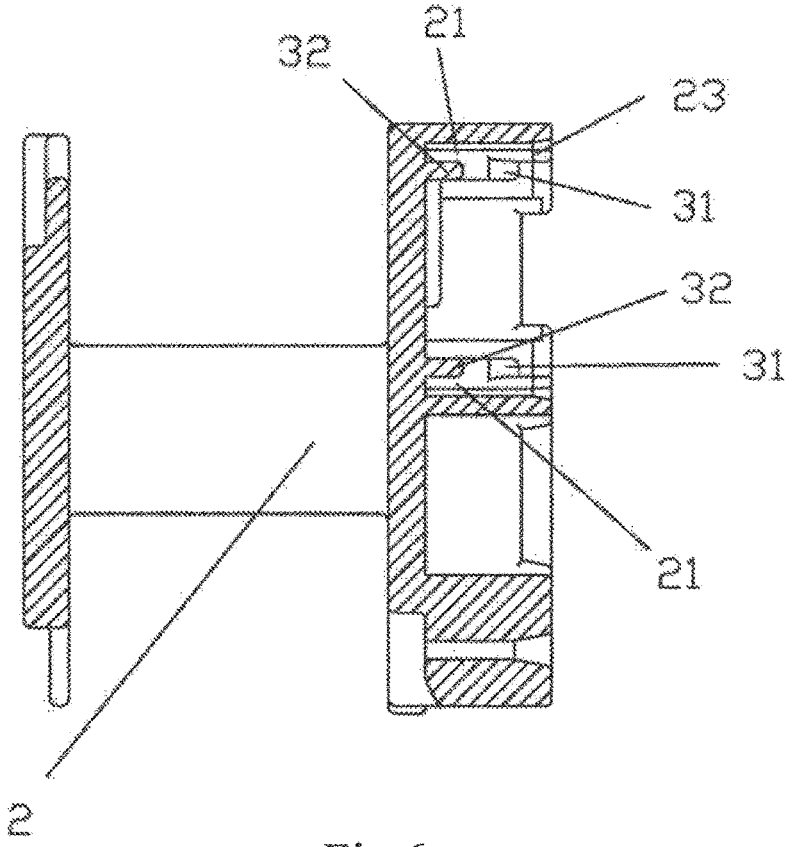
FIG. 6 is a cross-sectional view along line A-A in FIG. 5.
Figure 7:
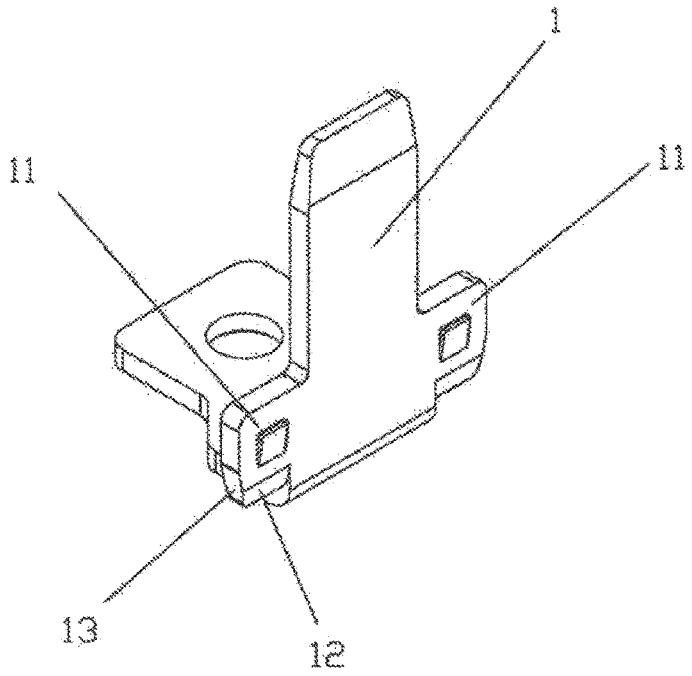
FIG. 7 is a schematic structural view of a static spring of an embodiment of the present disclosure.
Figure 8:
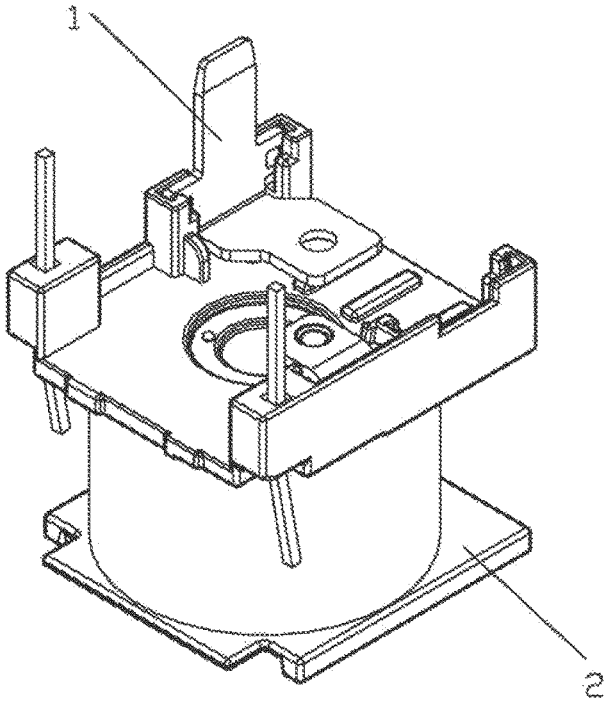
FIG. 8 is an assembled schematic view of a static spring and a bobbin of an embodiment of the present disclosure.
Figure 9:
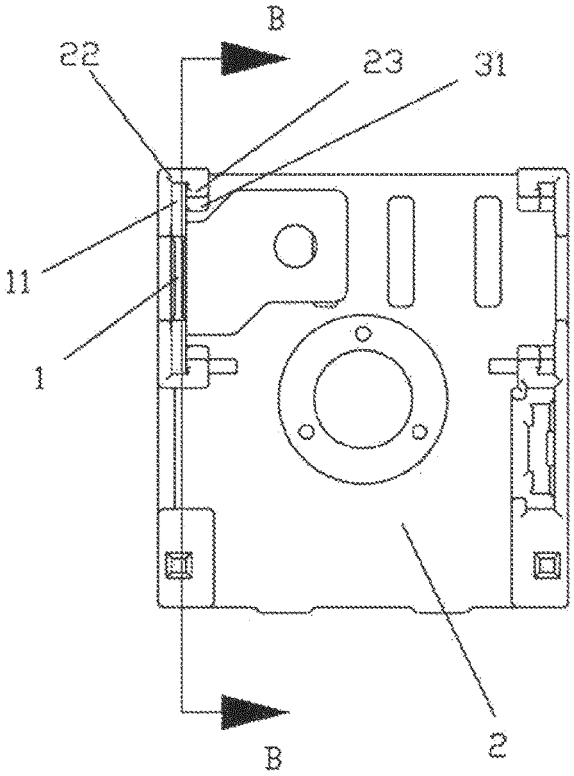
FIG. 9 is an assembled top view of a static spring and a bobbin of an embodiment of the present disclosure.
Figure 10:
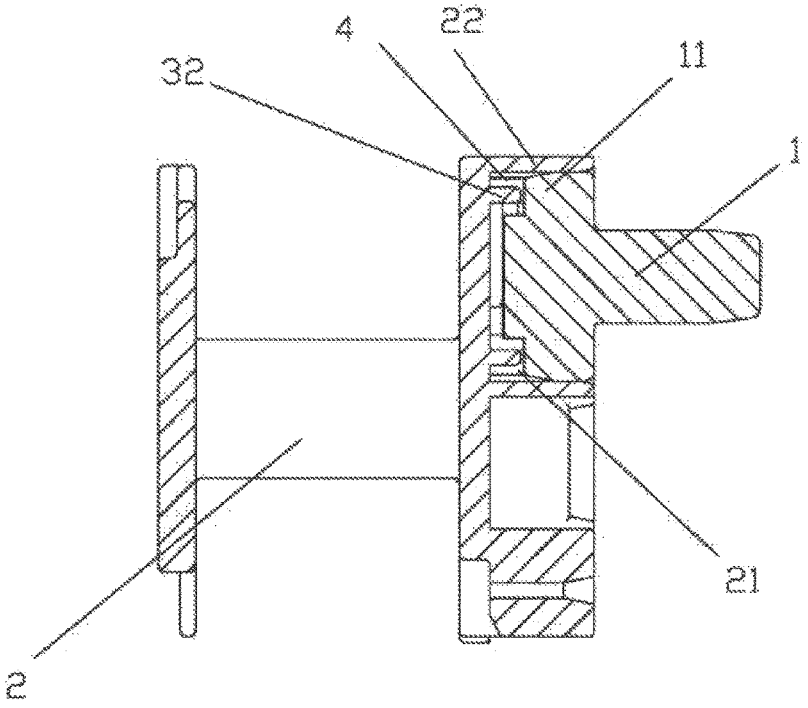
FIG. 10 is a cross-sectional view along a line B-B in FIG. 9.

The embodiments of the present disclosure relate to miniaturized relays. On one aspect, generated shaving debris can be enclosed in a specific space without going into inside of the relay/circuit breaker by improvement of a slot structure of the bobbin, thereby ensuring normal use of the relay/circuit breaker. On another aspect, the embodiments of the present disclosure can reduce volume of the relay by improvement of structures, thereby realizing miniaturization of product of the relay. On another aspect, the embodiments of the present disclosure can improve impact resistance of the product of the relay, and can reduce manufacturing cost of the product of the relay. On another aspect, the embodiments of the present disclosure can improve stability of operation of a double-contact moving spring by modification of a moving spring structure. The following is an exemplary description of structures of each part with reference to the accompanying drawings.

Referring to FIG. 3 to FIG. 10, an insertion structure between a static spring and a bobbin of the embodiments of the present disclosure includes a static spring 1 and a bobbin 2. The static spring 1 is provided with an L shape and is inserted into the bobbin 2 by a flip-chip method. The static spring 1 of the embodiments is designed as the L shape and may be designed as other shapes according to design requirements. The bobbin 2 is provided with slots 21, and each of the slots 21 having a groove shape with a laterally open is formed by an L-shaped side wall 22 connecting with a convex wall 23. Two sides of the static spring 1 are provided with convex parts 11 respectively. Two convex parts 11 of the static spring 1 are respectively fitted into the two opposite slots 21. That is, a convex part 11 at one side of the static spring is matched with the slots 21 at one side of the bobbin 2, and a convex part 11 at the other side of the static spring is matched with the slots 21 at the other side of the bobbin 2. Two slots 21 at the two sides are provided in a relative state. A first blocking wall 31 is further provided along a horizontally extending direction of protruding of a convex wall 23 of the bobbin 2. A second blocking wall 32 is further provided between the first blocking wall 31 and the L-shaped side wall 22 to connect the first blocking wall 31 and the L-shaped side wall 22. The convex parts 11 of the static spring is mounted at the second blocking wall 32, so that the shaving debris generated when the convex parts 11 of the static spring is inserted into the slots 21 of the bobbin 2 falls into a cavity enclosed by the first blocking wall 31, the second blocking wall 32, the L-shaped side wall 22 and the convex wall 23.

In the present embodiment, a height of the second blocking wall 32 is lower than the height of the first blocking wall 31.

In the present embodiment, the height of the first blocking wall 31 is lower than the height of the convex wall 23.

In the present embodiment, the first blocking wall 31 and the convex wall 23 are designed as an integrated structure, that is, the first blocking wall 31 is integrally formed with the convex wall 23.

In the present embodiment, the second blocking wall 32 and the first blocking wall 31 are designed as an integrated structure, that is, the second blocking wall 32 is integrally formed with the first blocking wall 32

In the present embodiment, the second blocking wall 32 is provided to vertically connect the first blocking wall 31 and a surface of the L-shaped side wall 22. Of course, the second blocking wall 32 may further be provided to obliquely connect the first blocking wall 31 and the surface of the L-shaped side wall 22. The second blocking wall 32 may be designed as a flat plate shape or an arc shape.

In the present embodiment, a bottom edge of the convex part 11 of the static spring is provided with a first wedge chamfer 12.

In the present embodiment, a side edge of the convex part 11 of the static spring is provided with a second wedge chamfer 13.

The static spring 1 can be easily inserted into the slots 21 of the bobbin 2 by utilizing the first wedge chamfer 12 at the bottom edge of the convex part 11 and the second wedge chamfer 13 at the side edge of the convex part 11.

Since the embodiment of the present disclosure adopts that the first blocking wall 31 is further provided along the horizontally extending direction of protruding of a convex wall 23 of the bobbin 2, and the second blocking wall 32 is further provided between the first blocking wall 31 and the L-shaped side wall 22 to connect the first blocking wall 31 and the L-shaped side wall 22, and the convex parts 11 of the static spring 1 is mounted at the second blocking wall 32, so that the shaving debris generated when the convex parts 11 of the static spring 1 is inserted into the slots 21 of the bobbin 2 falls into a cavity enclosed by the first blocking wall 31, the second blocking wall 32, the L-shaped side wall 22 and the convex wall 23. The structure of the embodiments of the present disclosure may enable the shaving debris generated when the convex parts 11 of the static spring 1 is inserted into the slots 21 of the bobbin 2 falls into a cavity enclosed by the first blocking wall 31, the second blocking wall 32, the L-shaped side wall 22 and the convex wall 23. After the static spring 1 is inserted into a specific position, the convex part 11 of static spring 1 blocks the cavity from the top, thus naturally forming a closed space, so that the shaving debris generated when the static spring 1 is inserted into the slots 21 are in the closed space and cannot enter inside of the relay, thereby ensuring normal use of the relay.

The present embodiment is applied to an assembly between the static spring and the bobbin, and of course, it can further be applied to the assembly between the static spring and a base.

The present embodiment is applied to the relay, and can further be used for a contactor or a circuit breaker.

A miniaturized relay with low-cost and high-load is provided. By improving of an installation structure of a contact part and a matching part of the moving spring armature part and the bobbin, the relay can achieve a purpose of small volume, large load and low cost.

Figure 11:
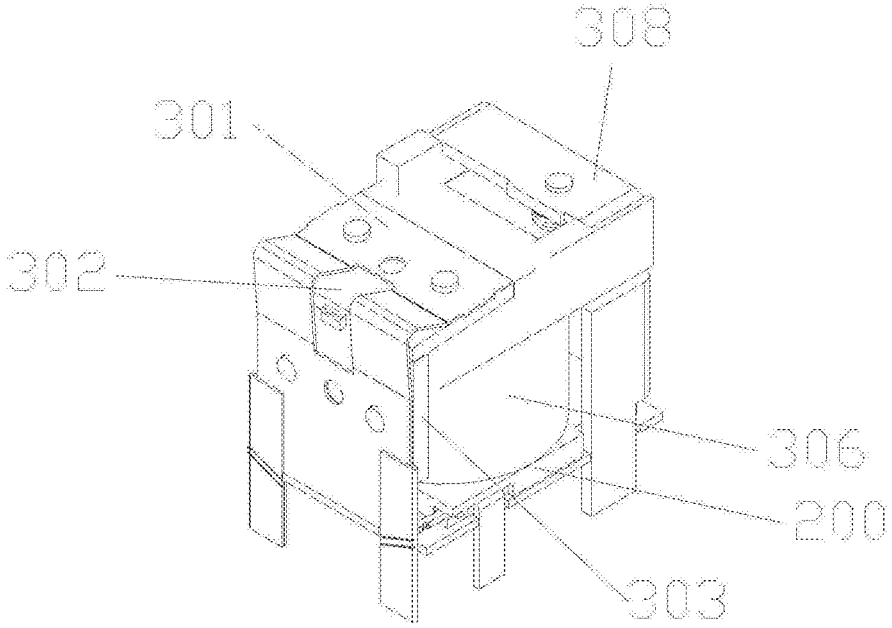
Fig.11 (Prior Art)
FIG. 11 is a perspective schematic view of a relay in the related art.
Figure 12:
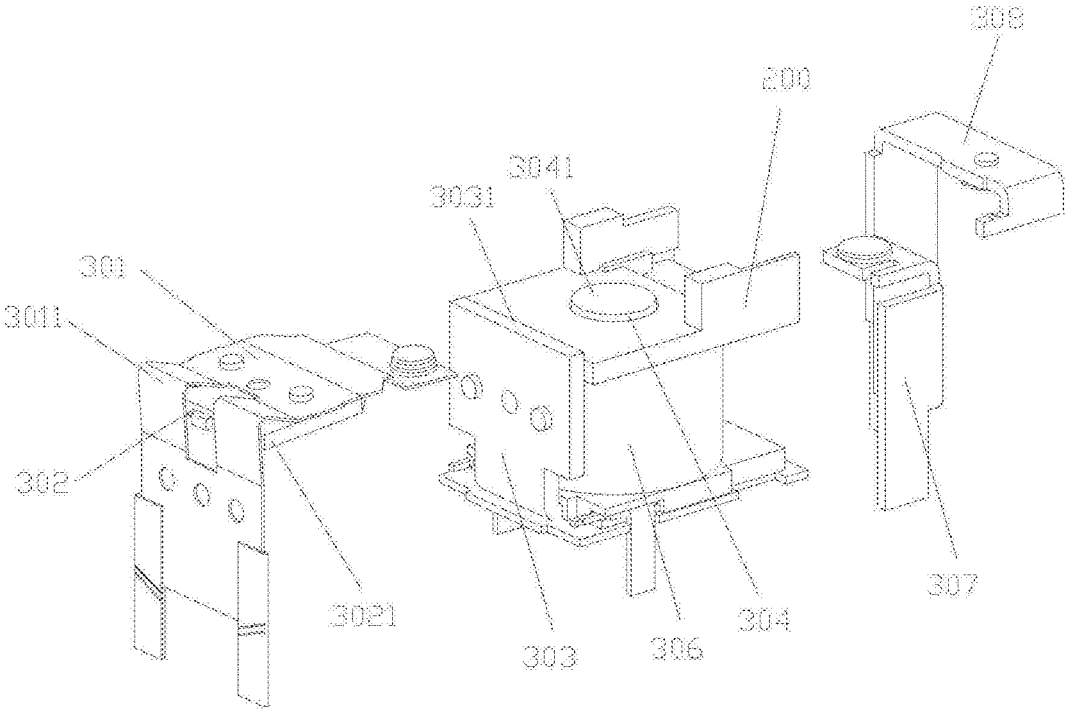
Fig.12 (Prior Art)
FIG. 12 is a disassembly perspective schematic view of a relay in the related art.
Figure 13:
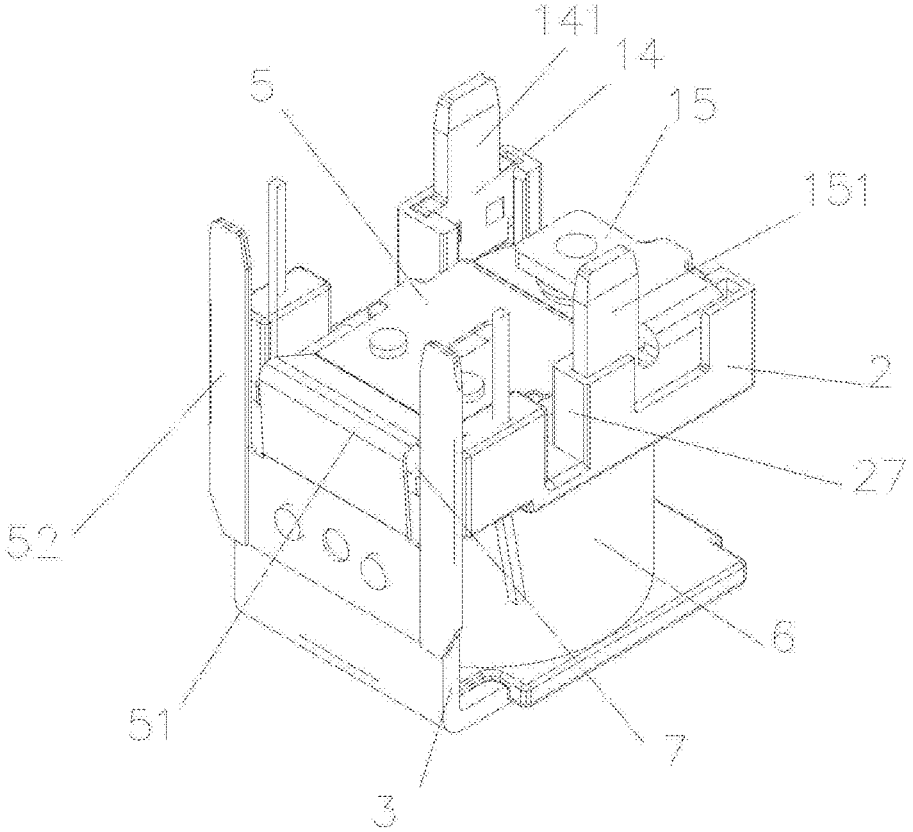
FIG. 13 is a schematic structural view of an embodiment (inversion state) of the present disclosure.
Figure 14:
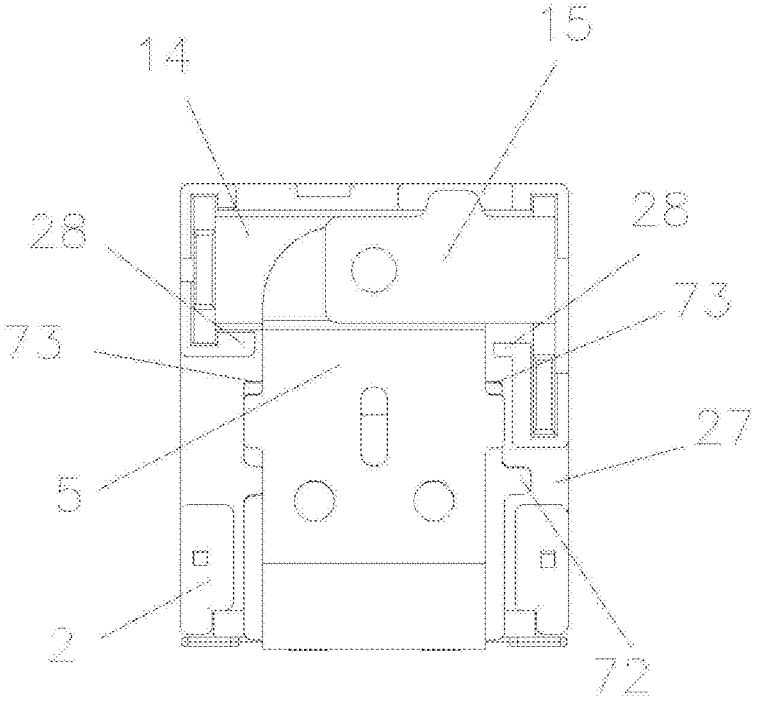
FIG. 14 is a top view of the embodiment of the present disclosure in FIG. 13.
Figure 15:
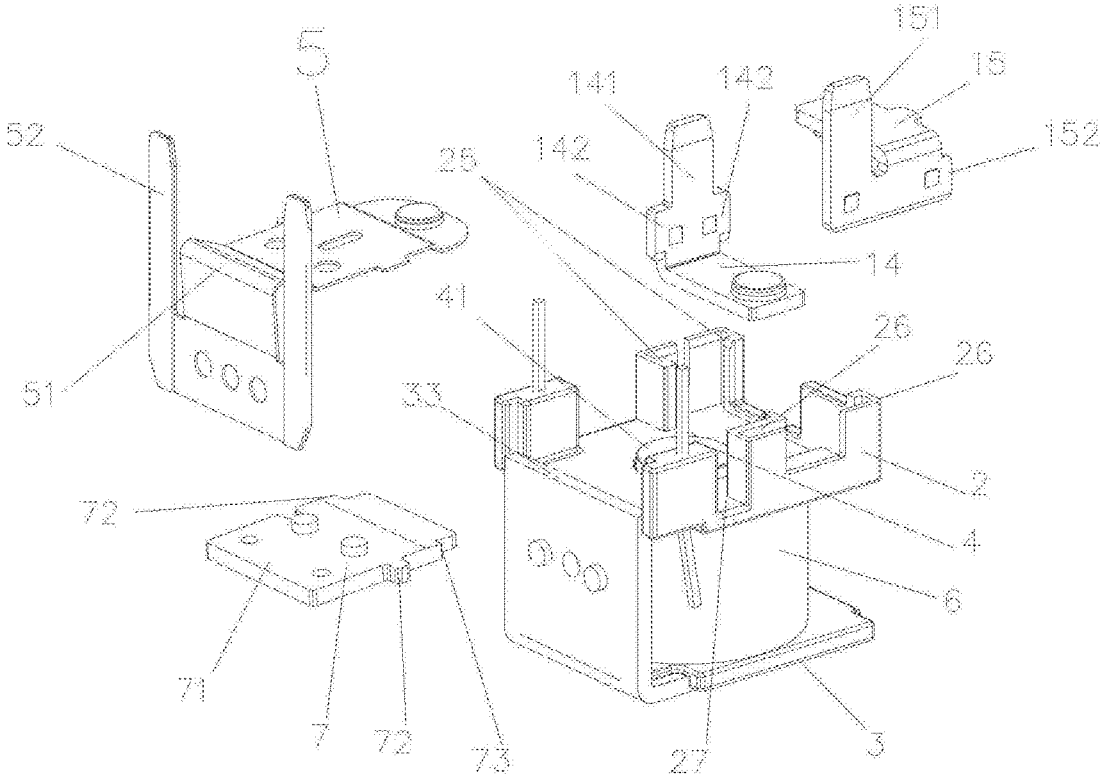
FIG. 15 is an exploded perspective schematic view of an embodiment (inversion state) of the present disclosure.
Figure 16:
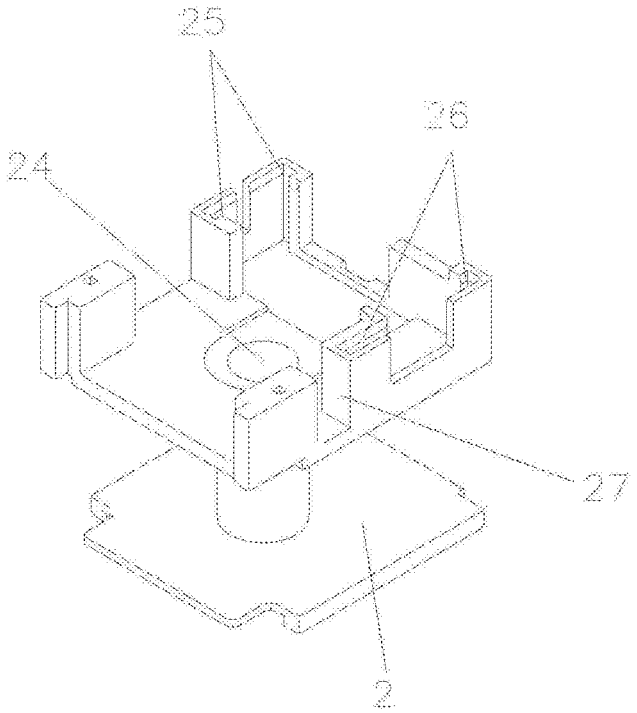
FIG. 16 is a perspective schematic view of a bobbin of an embodiment of the present disclosure.
Figure 17:
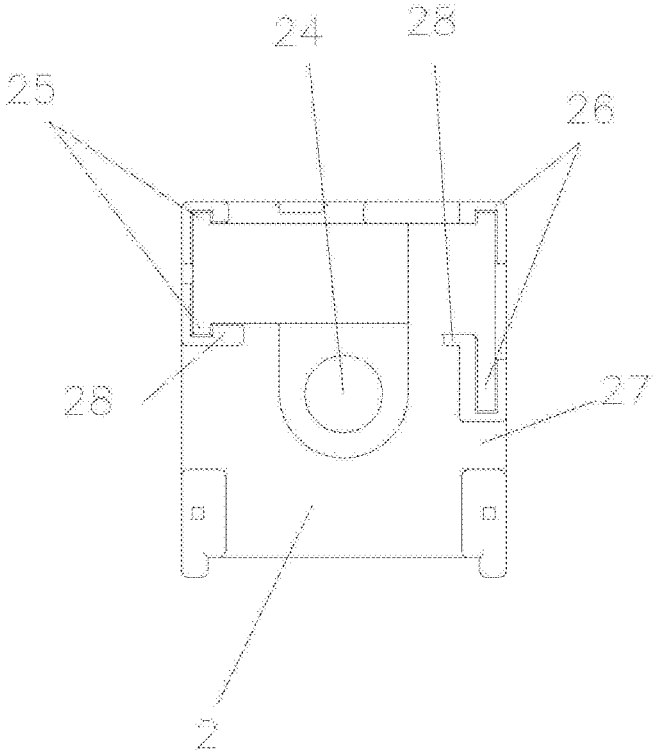
FIG. 17 is a top view of a bobbin of an embodiment of the present disclosure.
Figure 20:
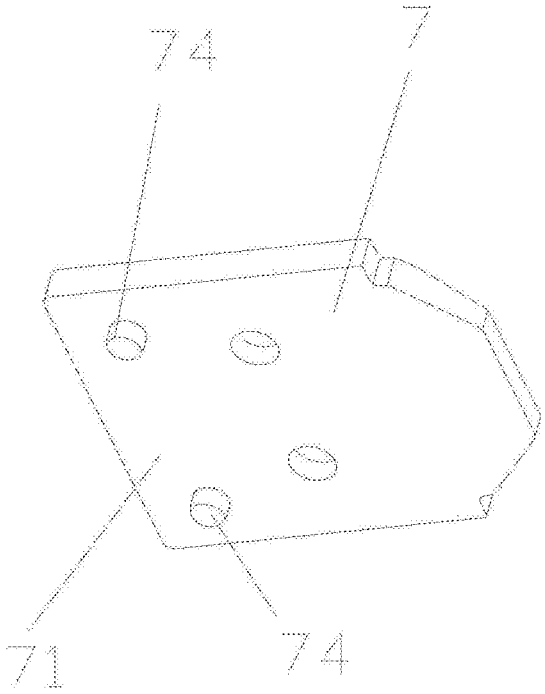
FIG. 20 is a perspective schematic view of an armature of an embodiment of the present disclosure.
Figure 21:
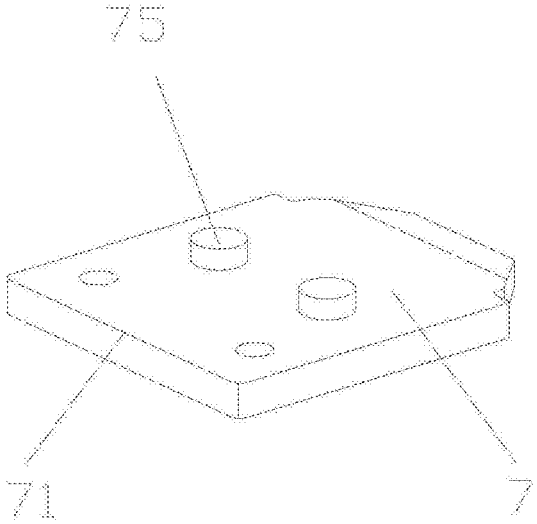
FIG. 21 is a schematic structural view of an armature (which is turned over to the other side) of an embodiment of the present disclosure.
Figure 22:
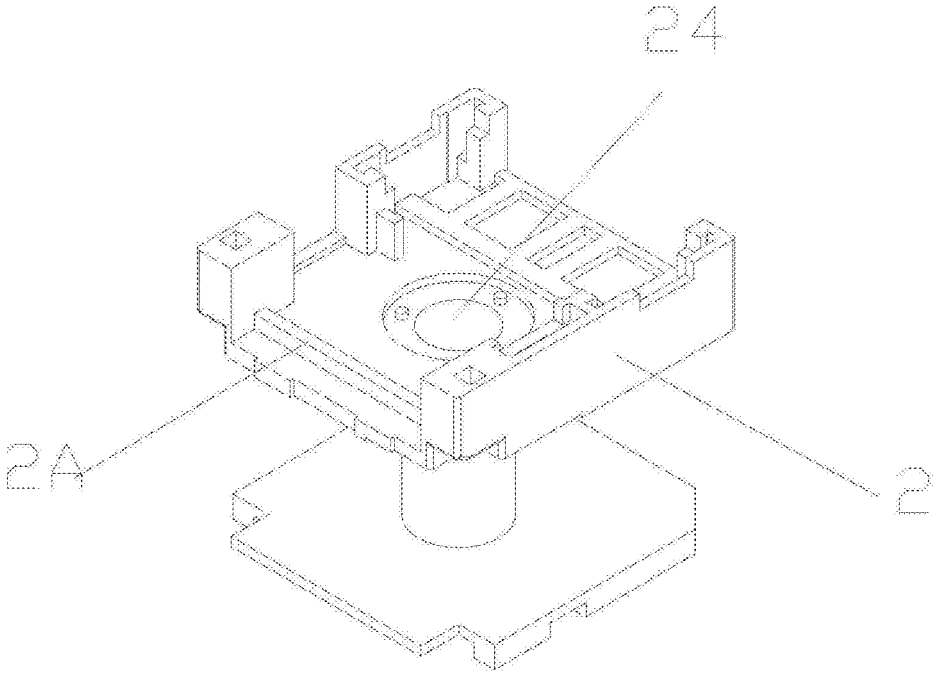
FIG. 22 is a schematic structural view of a bobbin of an embodiment of the present disclosure.
Figure 23:
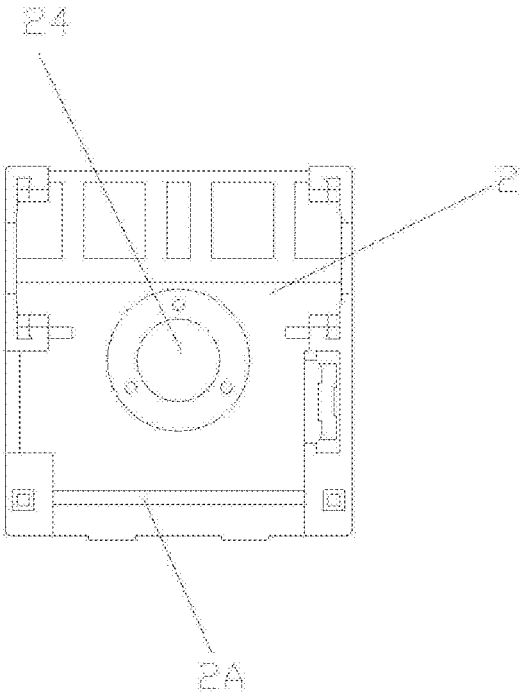
FIG. 23 is a top view of a bobbin of an embodiment of the present disclosure.
Figure 24:
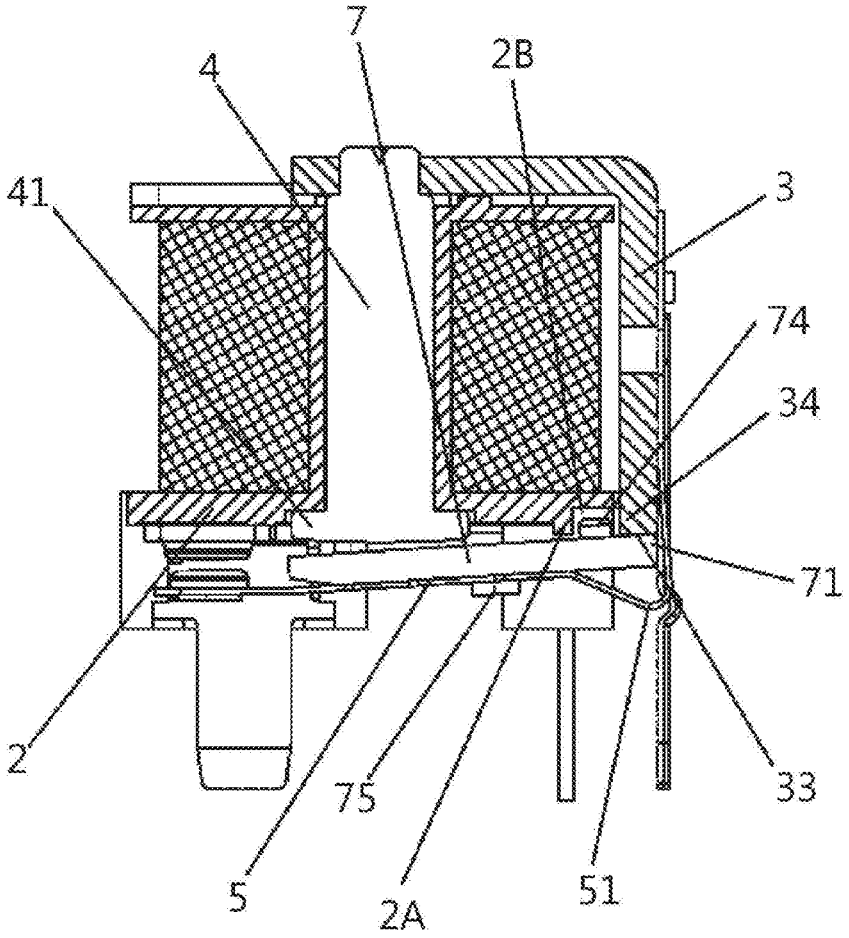
FIG. 24 is a schematic structural view of an embodiment of the present disclosure.

A rely of the related art is shown in FIG. 11, FIG. 12. The structure of the relay usually includes a moving spring armature part, a magnetic circuit part and a contact part. In the embodiment, the moving spring armature part include a moving spring 301 and an armature 302. The moving spring 301 is provided with a bending part 3011. After the moving spring 301 is bent, one edge thereof is fixed to the armature 302 to form a moving spring armature component. The magnetic circuit part includes a yoke iron 303, an iron core 304, a bobbin 200, and an enameled wire 306. The bobbin 200 and the enameled wire 306 wound at the bobbin 200 to constitute a coil. A head part 3041 of the iron core 304 is provided with a pole surface. The iron core 304 is mounted at a through hole of the bobbin 200. A tail end of the iron core 304 is fixed to one edge of the yoke iron 303 by riveting, and another edge of the yoke iron 303 is fixed to another side of the moving spring 301. In this structure, an end of another edge of the yoke iron 303 is provided as a knife edge 3031. A trail end 3021 of the armature 302 of the moving spring armature component is matched to the knife edge 3031 of the yoke iron 303. The contact part includes a normally opened static spring 307 provided with a normally opened static contact and a normally closed static spring 308 provided with a normally closed static contact. The relay of the related art is provided with the magnetic circuit part located at the bottom and the contact part located at the top, the contact part and leading pins of the moving spring are all at the bottom, which will result in that the amount of materials of a moving spring, a normally closed static spring, a normally opened static spring is large, and a conductive distance is long, and an internal resistance is large, so that the load of product is difficult to increase as a small volume. Although structures of some relays are designed as flip-chip structures, of which designed assembly is complicated. The static spring is usually fixed at a bottom plate, which will result in a dispersion of key dimensions and high precision requirements for parts of the product. Or the static spring is sidely inserted in the bobbin, which results in a complicated structure of the bobbin and a poor dimensional stability.

Referring to FIG. 13 to FIG. 17, a miniaturized relay with low-cost and high-load of the present embodiment includes a moving spring armature part, a magnetic circuit part and a contact part. In the embodiment, the moving spring armature part includes a moving spring 5 and an armature 7. The moving spring 5 has a bending part 51. The moving spring 5 is provided with the bending part 51 in order to make that the moving spring 5 has an elastic force. After the moving spring 5 is bent, one edge thereof is fixed to the armature 7 to form a moving spring armature component. The magnetic circuit part includes a yoke iron 3, an iron core 4, a bobbin 2 and an enameled wire 306. The enameled wire 306 is wound at the bobbin 2. A head part 41 of the iron core 304 is provided with a pole surface. The iron core 4 is mounted at a through hole of the bobbin 2. The tail end of the iron core 4 is fixed with the one side of the yoke iron 3 by riveting. Another side of the yoke iron 3 is fixed to another side of the moving spring 5. In the embodiment, an end of another edge of the yoke iron 3 is provided as a knife edge 33. A trail end 71 of the armature 7 of the moving spring armature component is matched to the knife edge 33 of the yoke iron 3. When the coil is energized, the armature 7 rotates around its trail end 71 and attached to the pole surface of the iron core 4. When the coil is de-energized, the armature 7 returns to its original position by the elastic force of the moving spring 5. The contact part includes a normally opened static spring 14 and a normally closed static spring 15. The normally opened static spring 14 and the normally closed static spring 15 are mounted to one end of the bobbin 2 installed with the pole surface of the iron core, so that the static contacts of the normally opened static spring 14 and the normally closed static spring 15 can match with a moving contact of the moving spring 5, and leading pins 141 of the normally opened static spring 14, leading pins 151 of the normally closed static spring 15, and leading pins 52 of the moving spring 5 are respectively oriented in a direction in which the moving contact and the static contacts are separated.

In the present embodiment, first convex parts 142 are respectively provided on two edges of the width of the normally opened static spring 14, and the bobbin 2 is provided with first slots 25 configured to match inserting the first convex parts 142 provided at the two edges of the normally opened static spring. The first slots 25 are formed by two opposite recess structures, and two recesses are respectively matched with two first convex parts 142.

In the present embodiment, the first slot 25 is a blind hole structure.

In the present embodiment, a second convex part 152 is provided on one edge of the width of the normally closed static spring 15. The bobbin 2 is provided with second slots 26 configured to match inserting the second convex part of the normally closed static spring. The second slot 26 is further formed by two opposite recess structures. One recess is configured to match the second convex part 152 and the other is configured to match a section of the leading pin 151 of another edge of the width. In this embodiment, the second slot 26 is a blind hole structure.

In the present embodiment, one side edge of the armature 7 is provided with a convex plate 72 that protrudes outward. In the bobbin 2, a groove 27 is provided at a position corresponding to the convex plate 72 of the armature. The convex plate 72 of the armature 7 is fitted into the groove 27 of the bobbin to form a limit in front and rear directions of the moving spring armature component by matching of the convex plate 72 and the groove 27. The convex plate 72 is matched with a side wall of the groove 27 to form an impact resistance of the moving spring armature component in a direction from a tail end of the armature toward the head part of the armature. The convex plate 72 is matched with another side wall of the groove 27 to form the impact resistance of the moving spring armature component in a direction from the head part of the armature toward the tail end of the armature.

In the present embodiment, stepped structures 73 are provided at two sides of the head part of the armature 7, respectively, convex shoulders 28 are provided at positions corresponding to the stepped structures 73 of the bobbin 2, respectively. By the matching of the convex shoulders 28 of the bobbin 2 and the stepped structures 73 of the armature 7, the impact resistance of the moving spring armature component in the direction from the tail end of the armature toward the head part of the armature may be formed.

The leading pins of the moving spring are formed by laminating the moving spring bodies.

A miniaturized relay with low-cost and high-load of the present embodiment adopts that the normally opened static spring 14 and the normally closed static spring 15 are flip-chip mounted to one end of the bobbin 2 installed with the pole surface of the iron core, and leading pins 141 of the normally opened static spring 14, leading pins 151 of the normally closed static spring 15, and the leading pins 52 of the moving spring 5 are respectively oriented in the direction in which the moving contact and the static contact are separated. The structure of the present embodiment is formed characteristics that the magnetic circuit part is located at the top and the contact part is located at the bottom, so that the normally opened static spring 14 and the normally closed static spring 15 are made of a less amount of material, and the conductive distance is short, and the internal resistance of the product is small, which achieves the purpose of reducing costs while meeting heavy load requirements of the product.

A miniaturized relay with low-cost and high-load of the present embodiment adopts that the first convex parts 142 are provided at the two edges of the width of the normally opened static spring 14, and the second convex part 152 is provided at the one edge of the width of the normally closed static spring 15, and the bobbin 2 is provided with the first slots 25 configured to match inserting the first convex parts 142 of the normally opened static spring and provided with a second slots 26 configured to match inserting the second convex part provided at one edge or two edges of the normally closed static spring, and the first slots 25, the second slot 26 are blind hole structures. The structure of the present embodiment can reduce the pollution of the shaving debris during process of the assembly, and has characteristics that a mold for making the bobbin is simple, the material for making the bobbin is reduced, the assembly of the static spring and the bobbin is easy, the pollution during the process of the assembly is reduced, and the cost is reduce.

A miniaturized relay with low-cost and high-load of the present embodiment adopts that the leading pins of the moving spring are formed this structure by laminating the moving spring bodies, which can improve a current carrying while satisfying a process manufacturability.

A miniaturized relay with low-cost and high-load of the present embodiment adopts that one side of the armature 7 is provided with the convex plate 72 that protrudes outward. In the bobbin 2, the groove 27 is provided at a position corresponding to the convex plate 72 of the armature. The convex plate 72 of the armature 7 is fitted in the groove 27 of the bobbin to form a limit in front and rear directions of the moving spring armature component by matching of the convex plate 72 and the groove 27. The structure of the present embodiment can make full use of a small space and improve the impact resistance of the product. The present embodiment further adopts that the stepped structures 73 are provided at two edges of the head of the armature 7, respectively, the convex shoulders 28 are provided at positions corresponding to the stepped structures 73 of the bobbin 2, respectively. By the matching of the convex shoulders 28 of the bobbin 2 and the stepped structures 73 of the armature 7, the impact resistance of the moving spring armature component in the direction from the tail end of the armature toward the head part of the armature may be formed. The structure of the present embodiment can make fully utilize of the matching of the armature and the bobbin to improve the impact resistance of the product.

A clapper-type relay of the related art is shown in FIG. 18, includes the yoke iron 303, the iron core 304, the bobbin 200, the enameled wire 306, the moving spring 301 and the armature 302, etc. The bobbin 200 and the enameled wire 306 wound on the bobbin 200 constitute a coil. After the moving spring 301 is bent, one edge thereof is fixed to the armature 302 to form a moving spring armature component. A head part 3041 of the iron core 304 is provided with a pole surface. The iron core 304 is mounted at a through hole of the bobbin 200. A tail end of the iron core 304 is fixed to one edge of the yoke iron 303 by riveting, and another edge of the yoke iron 303 is fixed to another edge of the moving spring 301, so that a clapper-type structure is formed. In this structure, the end of another edge of the yoke iron 303 is provided as the knife edge 3031. The trail end 3021 of the armature 302 of the moving spring armature component is matched to the knife edge 3031 of the yoke iron 303. When the coil is energized, the armature 302 rotates around its trail end 3021 and attached to the pole surface of the iron core 304. When the coil is de-energized, the armature 302 returns to its original position by the elastic force of the moving spring 301. The moving spring 301 is provided with the bending part 3011 which is further configured to make the moving spring 301 have the elastic force. The clapper-type relay with this structure is designed to implement impact resistance, that is, to resist the impact in the direction from the tail end 3021 of the armature 302 toward the head part of the armature 302, and a downward convex bract 3022 is provided at the tail end 3021 of the armature 302, a resistance to the impact in the direction from the tail end 3021 of the armature 302 to the head of the armature 302 is formed by use of the mutual matching limitation of the convex bract 3022 on the trail end 3021 of the armature 302 and a head end of the other side of the yoke iron 303. Since the convex bract 3022 needs to be formed at the trail end 3021 of the armature 302, on the one hand, the material for manufacturing the armature 302 is increased, and on the other hand, a notch 3012 is required to be provided in a middle of the bending part 3011 of the moving spring 301 to utilize the notch 3012 to avoid the convex bract 3022 of the armature 302. Since the notch 3012 is required to be provided in a middle of the bending part 3011 of the moving spring 301, in order to ensure a certain current carrying, it is necessary to increase the width dimension of the moving spring 301, so that the material of the moving spring 301 is also increased, and so that the volume of the clapper-type relay is increased, and miniaturization cannot be achieved. Further, the clapper-type relay with this structure is, since it is necessary to form the notch 3012 in the middle of the bending part 3011 of the moving spring 301, necessary to form the convex bract 3022 at the trail end 3021 of the armature 302, from which difficulty of manufacturing the moving spring and the convex bract is increased.

Referring to FIG. 19 to FIG. 24, a miniaturized anti-shock clapper-type relay of the present embodiment includes the bobbin 2, the yoke iron 3, the iron core 4, the moving spring 5 and the armature 7. The moving spring 5 is provided with the bending part 51. After the moving spring 5 is bent, one edge thereof is fixed to the armature 7 to form a moving spring armature component. The head part 41 of the iron core 4 is provided with a pole surface. The iron core 4 is mounted at the through hole of the bobbin 2. The tail end of the iron core is fixed with the one side of the yoke iron 3 by riveting, another edge of the yoke iron 3 is fixed to another edge of the moving spring 5 to constitute the clapper-type structure. In the embodiment, an end of another edge of the yoke iron 3 is provided as a knife edge 33. The trail end 71 of the armature 7 of the moving spring armature component is matched to the knife edge 33 of the yoke iron 3. When the coil is energized, the armature 7 rotates around its trail end 71 to attach to the pole surface of the iron core 4. When the coil is de-energized, the armature 7 returns to its original position by the elastic force of the moving spring 5. The moving spring 5 is provided with the bending part 51 in order to make the moving spring 5 has the elastic force. In order to do this, the bobbin 2, the yoke iron 3, the iron core 4 and the moving spring armature component are matched together according to a manner of the clapper-type structure. The convex bract structure of the related art at the tail end of the armature 7 is eliminated at the moving spring armature member. The notch structure of the related art is eliminated at the bending part of the moving spring 5. At the tail part of the armature 7, a first convex bract 74 projecting toward the bobbin is provided at a matching position close to the knife edge of the armature 3. A second convex bract 75 is provided at the other surface of the armature 7. The second convex bract 75 is configured to fix the movable spring 5 by riveting. At the bobbin 2, a retaining rib 2A is provided at a position close to the knife edge of the armature, and the retaining rib 2A and a terminal portion 34 of the armature at the knife edge of the armature are surrounded to form a groove 2B. The first convex bract 74 of the armature 7 is fitted in the groove 2B to form a limit on the moving spring armature component in two directions by the matching of the first convex bract 74 and the groove 2B.

In the present disclosure, the retaining rib 2A is designed as a strip shape, and the retaining rib 2A is between the knife edge 33 of the armature and the pole surface of the iron core. And the retaining rib 2A is substantially parallel to the terminal portion 34 of the armature at the knife edge of the armature.

In the present disclosure, the first convex bract 74 and the retaining rib 2A are provided with a preset gap. The matching of the first convex bract 74 and the retaining rib 2A can form the impact resistance of the moving spring armature component in the direction from the tail end of the armature toward the head part of the armature.

In the present disclosure, the first convex bract 74 and the terminal portion 34 of the armature at the knife edge of the armature are provided with a preset gap. The matching of the first convex bract 74 and the terminal portion 34 of the armature at the knife edge of the armature can form the impact resistance of the moving spring armature component in the direction from a head part of the armature toward the tail end of the armature. In the present disclosure, the number of the first convex bract 74 is two.

A miniaturized anti-shock clapper-type relay of the present embodiment adopts that at the tail end 71 of the armature 7, the first convex bract 74 projecting toward the bobbin is provided at a matching position close to the knife edge 33 of the armature. At the bobbin 2, the retaining rib 2A is provided at the position close to the knife edge of the armature, and the retaining rib 2A and the terminal portion 34 of the armature at the knife edge of the armature are surrounded to form the groove 2B. The first convex bract 74 of the armature 7 is fitted in the groove 2B to form the limit on the moving spring armature component in the two directions by the matching of the first convex bract 74 and the groove 2B. This structure of the present disclosure, by matching the first convex bract 74 in the groove 2B, the impact resistance of the moving spring armature component in the direction from an tail end of the armature toward the head part of the armature can be formed, and the impact resistance of the moving spring armature component in the direction from an head part of the armature toward the tail end of the armature can further be formed, which greatly improves the impact resistance of relay products.

A miniaturized anti-shock clapper-type relay of the present embodiment adopts that the convex bract structure of the related art is eliminated at the tail end of the armature. The notch structure of the related art is eliminated at the bending part of the moving spring 5, so that the width of the moving spring is reduced, and the volume of the relay may be reduced, thereby advantageous for miniaturization of relay products. This structure of the present disclosure further reduces the material for manufacturing the armature, the material for manufacturing the moving spring, and the cost of the relay, and improves the competitiveness of the product. This structure of the present disclosure makes the moving spring and the armature easy to manufacture, and further reduces the manufacturing cost of the relay.

A miniaturized anti-shock clapper-type relay of the present embodiment adopts that the retaining rib 2A is added to the bobbin 2, which is configured to supplement of a rib reinforcement of the bobbin, which can prevent the deformation of the bobbin. Since the retaining rib 2A is disposed between the knife edge 33 of the yoke iron and the pole surface of the iron core, conducive to isolating the material produced by contact ablation from the knife edge of the yoke iron.

The present embodiment provides a relay capable of improving the stability of the double-contact moving spring. By improving the structure of the double-contact moving spring, the double-contact moving spring can reach a steady state more quickly when the relay is released and operated, thereby improving electrical life performance of the product.

Figure 25:
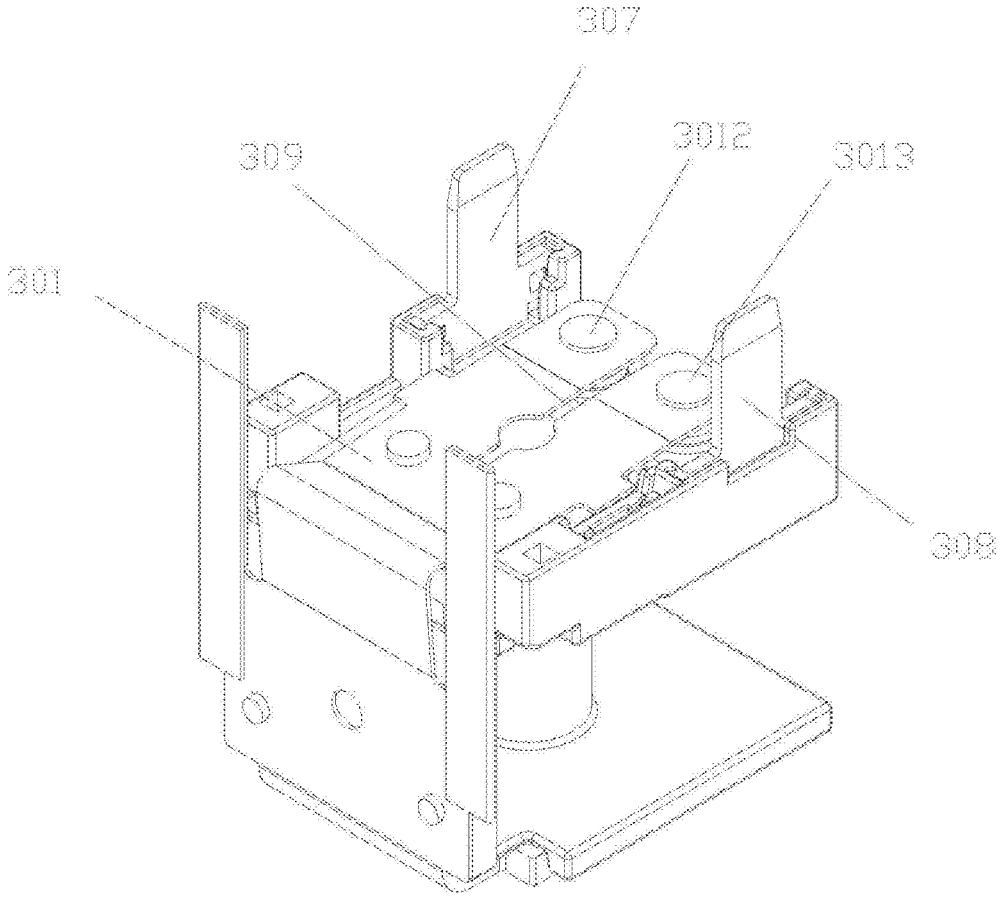
FIG. 25 is an assembled schematic view of a part of components of a relay provided with a double-contact moving spring in the related art.
Figure 26:
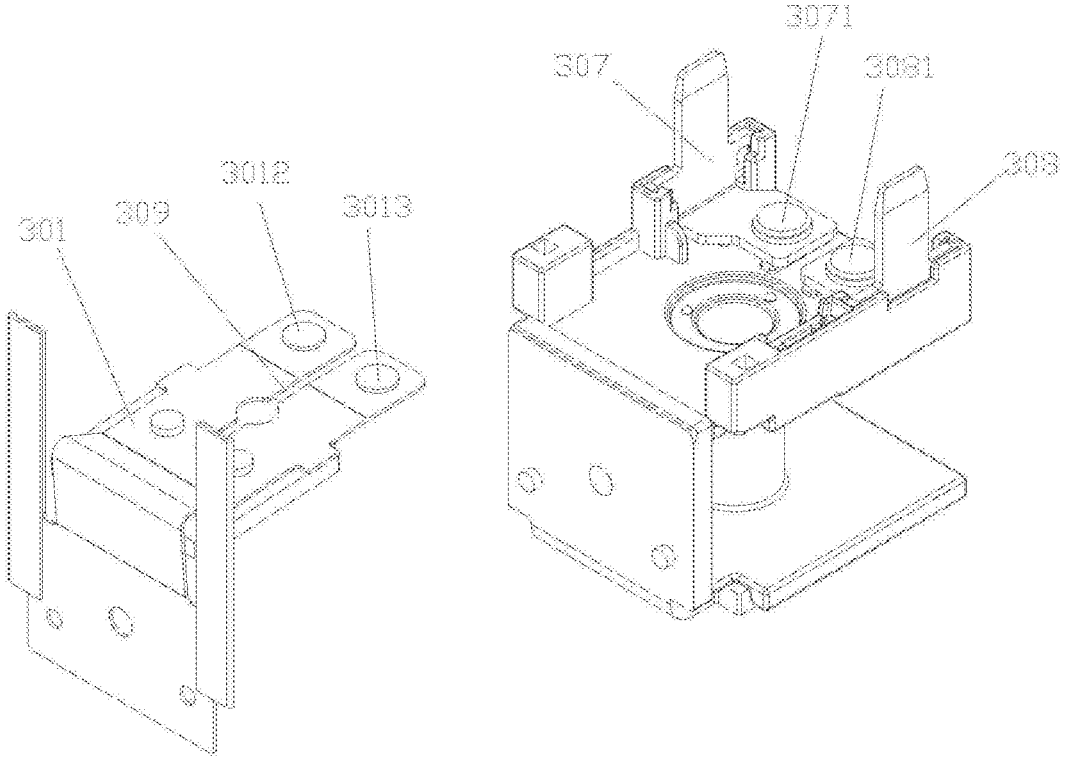
Fig.26 (Prior Art)
FIG. 26 is an exploded schematic view of structures in FIG. 25.

A relay with a double-contact moving spring of the related art is shown in FIG. 25 and FIG. 26. The relay includes a double-contact moving spring and two static springs. The double-contact moving spring includes a moving spring 301 and two moving contacts 3012, 3013 fixed to the moving spring 301. The two static springs are a first static spring 307 and a second static spring 308. The first static spring 307 is fixed with a static contact 3071, and the second static spring 308 is fixed with a static contact 3081. The moving spring 301 is provided with a slot 309 extending inwardly from the head part to divide the moving spring 301 into two parts. Free end parts of the two parts are respectively connected to the moving contact 3012 and the moving contact 3013. Root parts of the two parts are integrally connected. When the relay is operated, the moving contact 3012 of the double-contact spring is in contact with the static contact 3071 of the first static spring 307. The moving contact 3013 of the double-contact moving spring is in contact with the static contact 3081 of the second static spring 308. When the relay is released, the moving contact 3012 of the double-contact moving spring is separated from the static contact 3071 of the first static spring 307. The moving contact 3013 of the double-contact moving spring is separated from the static contact 3081 of the second static spring 308. In order to satisfy a suction force of the relay product, the slot 309 of the moving spring 301 is designed to be long, so that the length of split of the moving spring 301 is long. In this structure, during the operation of the relay, since the head part of the moving spring 301 is a bifurcated structure, the two bifurcations do not pull each other, thereby resulting in a long rebound time of the relay, the moving spring takes a long time to stabilize, which seriously affects the electrical life performance of the product. During the process of releasing of the relay, since the moving spring 301 is designed as a bifurcated structure, two parts of the moving spring 301 bifurcated will dampen vibrations in the process of releasing, and finally stabilize. This stable process takes a long time. During the vibration process, the relay will re-ignite, thereby causing the performance of the product to drop.

Figure 27:
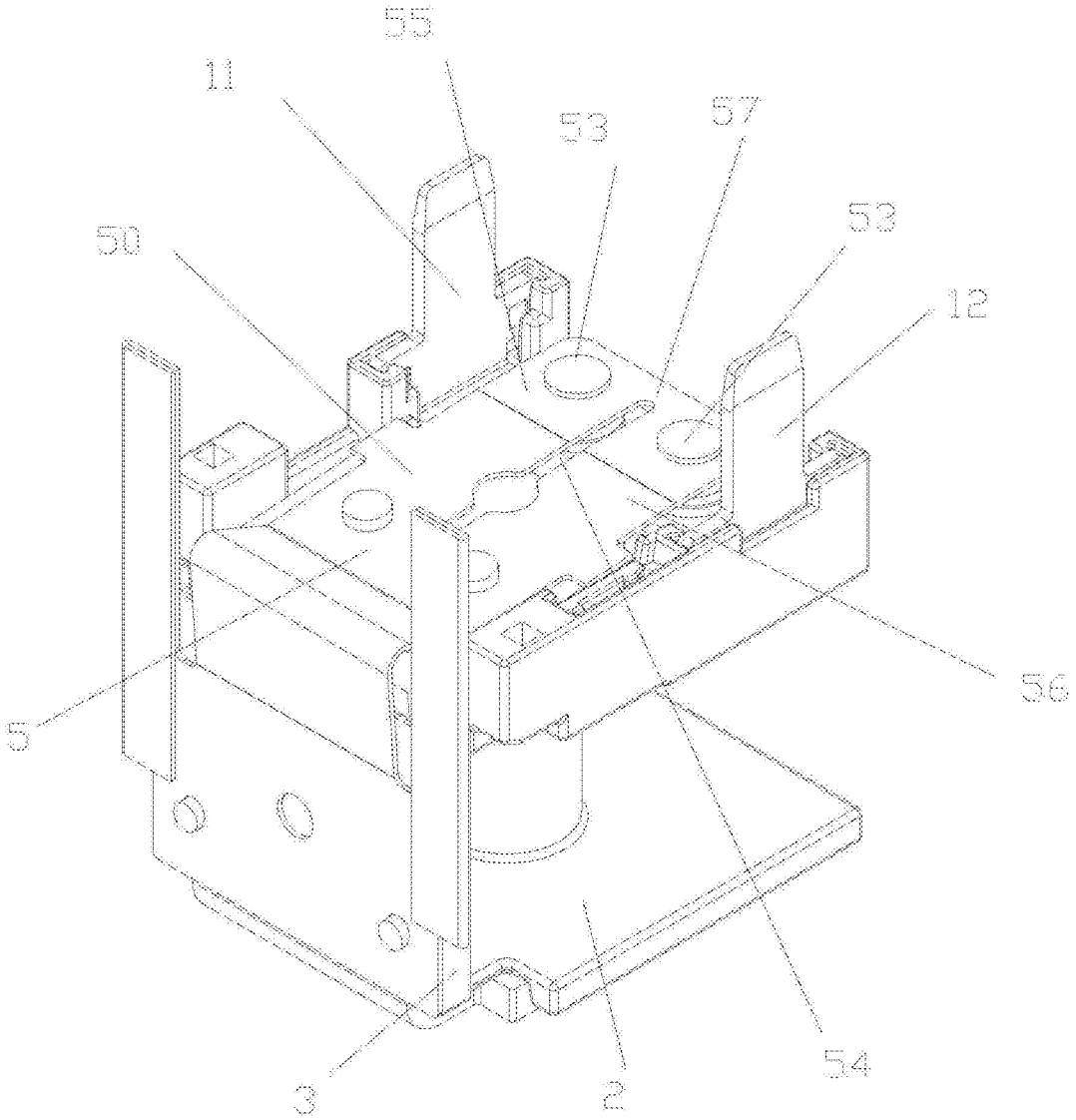
FIG. 27 is an assembled schematic view of a part of components of an embodiment of the present disclosure.
Figure 28:
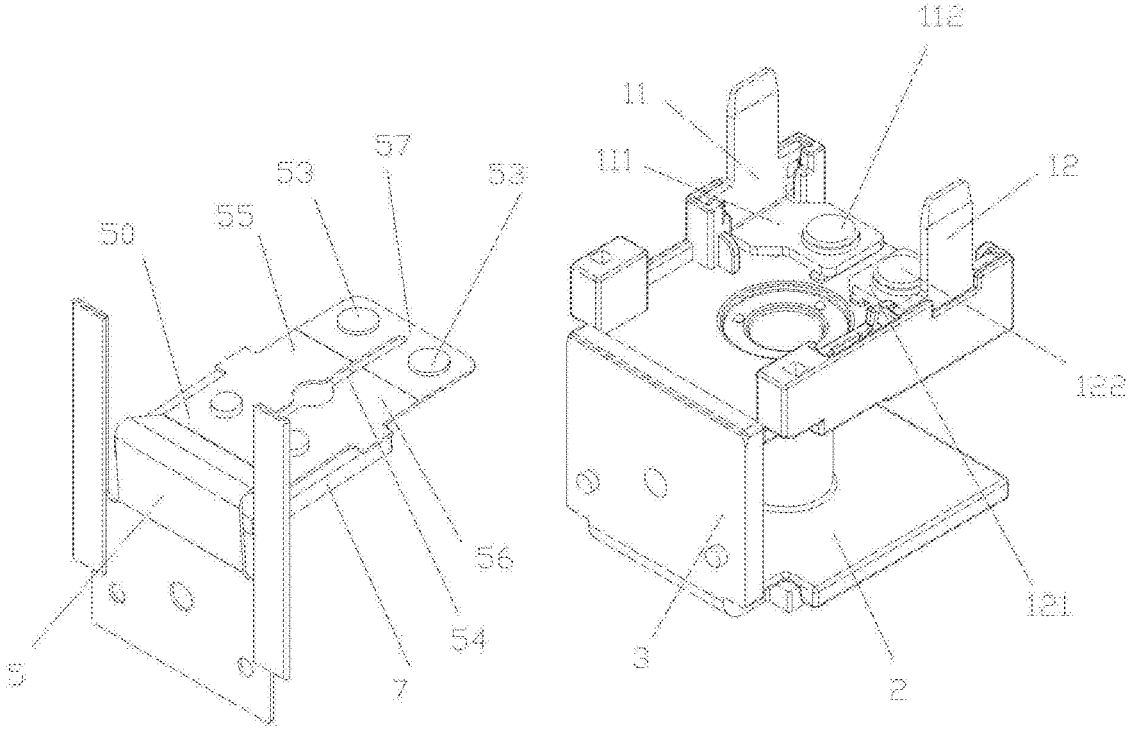
FIG. 28 is an exploded schematic view of structures in FIG. 27.

Referring to FIG. 27 and FIG. 28, a relay capable of improving the stability of the double-contact moving spring of the present embodiment includes a double-contact moving spring and two static springs 11, 12. The double-contact moving spring 5 includes a moving spring reed 50 and two moving contacts 53 fixed to the moving spring. The static spring 11 includes a static spring reed 111 and a stationary contact 112 fixed to the static spring reed. The static spring 12 includes a static spring reed 121 and a stationary contact 122 fixed to the static spring reed. The moving spring reed 50 is bent into an L shape. One side of the moving spring reed 50 is fixed to the armature 7. The other side of the moving reed 50 is fixed to the main yoke iron 3. The yoke iron 3 is matched with the bobbin 2. One end of the armature 7 is matched to the knife edge of the yoke iron 3. The static spring 11 and the static spring 12 are mounted on the bobbin 2, respectively. The two moving contacts 53 of the double-contact moving spring are respectively corresponding to and adapted to the static contacts 112, 122 of the two static springs. The moving spring reed 50 is provided with a slot 54 extending inwardly from the head part to divide the moving spring reed into two parts 55, 56. One of the free end parts of the two parts 55, 56 of the moving spring is respectively connected to one of the moving contacts 53. The root parts of the two parts 55, 56 of the moving spring are integrally connected. A connecting part 57 is further provided between the free end parts of the two parts of the moving spring reed. The connecting part 57 is integrally connected between the free end parts of the two parts 55, 56 of the moving spring reed.

In the present embodiment, the connecting part 57 is vertically connected between the free end parts of the two parts 55, 56 of the moving spring reed.

In the present embodiment, the connecting part 57 is connected between the ends of the free end parts of the two parts 55, 56 of the moving spring reed.

In the present embodiment, the connecting part 57 is vertically connected between the ends of the free end parts of the two parts 55, 56 of the moving spring reed.

In the present embodiment, one end of the slot 54 extends to the junction of the moving spring reed 50 and the armature 7, and the other end of the slot 54 passes over a connecting line between centers of the two moving contacts 53.

In the present embodiment, the moving contact 53 and the moving spring reed 50 are fixed by riveting, and of course, may be fixed by welding.

In the present embodiment, the static contacts 112, 122 and corresponding static spring reeds 111, 112 are fixed by riveting, and of course, may be fixed by welding.

A relay capable of improving the stability of the double-contact moving spring of the present embodiment adopts that a connecting part 57 is further provided between the free end parts of the two parts 55, 56 of the moving spring reed. The connecting part 57 is integrally connected between the free end parts of the two parts 55, 56 of the moving spring reed. This structure of the present disclosure, since the head parts of the bifurcated parts of the moving spring reed are connected to each other, in the vibration process, they play a role in mutual restraint, which makes that the double-contact moving spring can reach a steady state more quickly when the relay is released and operated, thereby improving electrical life performance of the product.

The above contents are only preferred embodiments of the present disclosure and are not intended to limit the present disclosure in any form. While the present disclosure has been described above in the preferred embodiments, it is not intended to limit the present disclosure. Any person skilled in the art can make many possible variations and modifications to the technical solutions of the present disclosure by using the above-disclosed technical contents, or modify to equivalent embodiments without departing from the scope of the technical solutions of the present disclosure. Therefore, any simple modifications, equivalent changes, and modifications to the above embodiments in accordance with the technical essence of the present disclosure should fall within the scope of the present disclosure.

What is claimed is:

1. An insertion structure between a stationary spring and a bobbin, comprising:

A stationary spring and a bobbin; wherein the stationary spring is inserted into the bobbin by a flip-chip method, and the bobbin is provided with slots, each of the slots having a groove shape with a laterally open is formed by an L-shaped side wall connecting with a convex wall, and each of two sides of the stationary spring is provided with a convex part respectively, and two convex parts of the stationary spring are respectively fitted in two opposite slots; wherein a first blocking wall is further provided along a horizontally extending direction of protruding of the convex wall of the bobbin, and a second blocking wall is further provided between the first blocking wall and the L-shaped side wall to connect the first blocking wall and the L-shaped side wall, and the convex parts of the stationary spring are mounted at the second blocking wall, so that shaving debris generated when the convex parts of the stationary spring are inserted into the slots of the bobbin falls into a cavity enclosed by the first blocking wall, the second blocking wall, the L-shaped side wall and the convex wall.

2. The insertion structure between the stationary spring and the bobbin according to claim 1, wherein a height of the second blocking wall is lower than the height of the first blocking wall.

3. The insertion structure between the stationary spring and the bobbin according to claim 2, wherein the first blocking wall and the convex wall are designed as an integrated structure.

4. The insertion structure between the stationary spring and the bobbin according to claim 3, wherein the second blocking wall and the first blocking wall are designed as an integrated structure.

5. The insertion structure between the stationary spring and the bobbin according to claim 2, wherein the second blocking wall is provided to vertically connect between the first blocking wall and a surface of the L-shaped side wall.

6. The insertion structure between the stationary spring and the bobbin according to claim 1, wherein the stationary spring is designed as an L shape.

7. The insertion structure between the stationary spring and the bobbin according to claim 2, wherein the height of the first blocking wall is lower than the height of the convex wall.

8. The insertion structure between the stationary spring and the bobbin according to claim 1, wherein a bottom edge of the convex part of the stationary spring is provided with a first wedge chamfer.

9. The insertion structure between the stationary spring and the bobbin according to claim 8, wherein a side edge of the convex part of the stationary spring is provided with a second wedge chamfer.

10. The insertion structure between the stationary spring and the bobbin according to claim 1, wherein the first blocking wall and the convex wall are designed as an integrated structure.

11. The insertion structure between the stationary spring and the bobbin according to claim 1, wherein the second blocking wall is provided to vertically connect between the first blocking wall and a surface of the L-shaped side wall.

* * * * *